US009200864B2

(12) United States Patent
Lin

(10) Patent No.: US 9,200,864 B2
(45) Date of Patent: Dec. 1, 2015

(54) ELECTRIC TOY GUN STRUCTURE

(71) Applicant: LONEX TECHNOLOGY CO., LTD., New Taipei (TW)

(72) Inventor: Nien-Chun Lin, New Taipei (TW)

(73) Assignee: LONEX TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 14/178,667

(22) Filed: Feb. 12, 2014

(65) Prior Publication Data

US 2015/0226513 A1 Aug. 13, 2015

(51) Int. Cl.
*F41B 7/08* (2006.01)
*F41B 7/00* (2006.01)

(52) U.S. Cl.
CPC .. *F41B 7/08* (2013.01); *F41B 7/003* (2013.01)

(58) Field of Classification Search
CPC ..... F41B 3/00; F41B 7/08; F41B 7/003
USPC ..... 124/14, 32, 60, 6
See application file for complete search history.

(56) References Cited

U.S. PATENT DOCUMENTS 4,850,330 A * 7/1989 Nagayoshi ..... F41B 11/723 124/50
5,775,312 A * 7/1998 Wilkinson ..... F41B 11/642 124/67
5,924,413 A * 7/1999 Johnson ..... F41B 11/54 124/72
7,069,922 B1 * 7/2006 Orr ..... F41A 23/10 124/73
7,694,448 B2 * 4/2010 Iwasawa ..... F41B 11/89 124/54
8,056,276 B2 * 11/2011 Hu ..... F41A 33/06 124/65
8,074,392 B2 12/2011 Hu
8,585,407 B2 11/2013 Hu
2009/0071456 A1 * 3/2009 Chia ..... F41B 7/08 124/16
2012/0138038 A1 6/2012 Lee

* cited by examiner

*Primary Examiner* — Gene Kim
*Assistant Examiner* — Jeffrey Vanderveen
(74) *Attorney, Agent, or Firm* — Pai Patent & Trademark Law Firm; Chao-Chang David Pai

(57) ABSTRACT

An electric toy gun structure includes a casing having a room therein and a rear end with a through hole communicating with the room; a firing mechanism disposed in the room, the firing mechanism having a piston corresponding to the through hole; a guide pipe coupled at the rear end of the casing and communicating with the through hole; a hit rod movably disposed in the guide pipe, the hit rod having a first end and a second end, the first end passing through the through hole and being located in the room, the second end being coupled with a weight, a first elastic member disposed in the room, one end being against the piston and the other end being against the hit rod; and a second elastic member disposed in the guide pipe, one end being against the casing and the other end being against the weight.

13 Claims, 5 Drawing Sheets

ELECTRIC TOY GUN STRUCTURE

BACKGROUND OF THE INVENTION (a) Field of the Invention

The present invention relates to an electric toy gun structure, and more particularly to an electric toy gun structure for shooting plastic bullets (BB bullets).

(b) Description of the Prior Art

Conventional toy guns used for war games are air guns, gas guns, electric guns and so on for the players to shoot plastic bullets (BB bullets) or other material bullets. As disclosed in U.S. Pat. No. 8,585,407, U.S. Pat. No. 7,694,448, and US20120138038, the electric gun comprises a plurality of pivots and gears therein, so that the power of the motor can be transmitted to the firing mechanism through the pivots and the gears for shooting bullets. The electric gun shoots plastic bullets through compressed air. The weight of one plastic bullet is about 0.12 g to 1 g. The initial speed of shooting is about 100 M/Sec. Therefore, the player cannot feel the recoiling effect when shooting the plastic bullets.

A toy gun to simulate the recoiling effect is developed. Through a piston to reciprocate or in other ways to generate vibrations, the toy gun provides a vibration effect when shooting, but it is not like a real recoiling effect. Besides, the elastic members (springs) used to push the firing mechanism in the casing of the toy gun will fatigue after a period of time. It is necessary to disassemble the toy gun for maintenance and replacement. However, the design of the conventional toy gun is unable to take out the elastic members from the rear end of the casing. It is required to disassemble the whole casing of the toy gun, so the maintenance and replacement are difficult and inconvenient.

Accordingly, the inventor of the present invention has devoted himself based on his many years of practical experiences to solve these problems.

SUMMARY OF THE INVENTION

The primary object of the present invention is to provide an electric toy gun structure. Through the improvements of the interior structure, the electric toy gun can achieve a vibration effect and can be disassembled and maintained with ease.

In order to achieve the aforesaid object, the electric toy gun structure of the present invention comprises a casing, a firing mechanism, a guide pipe, a hit rod, a first elastic member, and a second elastic member. The casing has a room therein. The casing has a rear end with a through hole communicating with the room. The firing mechanism is disposed in the room. The firing mechanism has a piston corresponding to the through hole. The guide pipe is coupled at the rear end of the casing and communicates with the through hole. The hit rod is movably disposed in the guide pipe. The hit rod has a first end and a second end. The first end of the hit rod passes through the through hole and is located in the room. The second end of the hit rod is coupled with a weight. The first elastic member is disposed in the room. A first end of the first elastic member is against the piston, and a second end of the first elastic member is against the hit rod. A second elastic member is disposed in the guide pipe. A first end of the second elastic member is against the casing, and a second end of the second elastic member is against the weight.

Preferably, the electric toy gun structure further comprises a tubular stop sleeve. The stop sleeve is fitted on the first end of the hit rod. The second end of the first elastic member is against the stop sleeve.

Preferably, the stop sleeve has a first stop portion. The first elastic member is a spiral spring fitted in the stop sleeve. The second end of the first elastic member is against the first stop portion.

Preferably, the weight has a diameter greater than that of the hit rod. The weight is formed with a second stop portion. The second elastic member is a spiral spring fitted on the hit rod and is against the second stop portion.

Preferably, the electric toy gun structure further comprises a tubular shaft sleeve. The shaft sleeve is disposed in the through hole. The first end of the hit rod passes through the shaft sleeve to be located in the room.

Preferably, the rear end of the casing is provided with a connecting protrusion. The through hole passes through the connecting protrusion. A front end of the guide pipe is coupled to the connecting protrusion.

Preferably, the connecting protrusion has first threads thereon, and the front end of the guide pipe has second threads therein to engage with the first threads.

Preferably, a rear end of the guide pipe is coupled with an end plug.

Preferably, the rear end of the guide pipe has third threads therein, and the end plug has fourth threads thereon to engage with the third threads.

Accordingly, when the electric toy gun structure of the present invention shoots bullets, the weight of the hit rod will hit the end plug to provide a vibration effect like a real gun to shoot bullets. The end plug can be detached from the guide pipe to take out the hit rod, the shaft sleeve, the stop sleeve, the first elastic member, and the second elastic member to replace the elastic members, so the present invention can be disassembled and maintained with ease.

DETAILED DESCRIPTION OF THE PREFERRED EMBODIMENTS

Embodiments of the present invention will now be described, by way of example only, with reference to the accompanying drawings.

Figure 2:
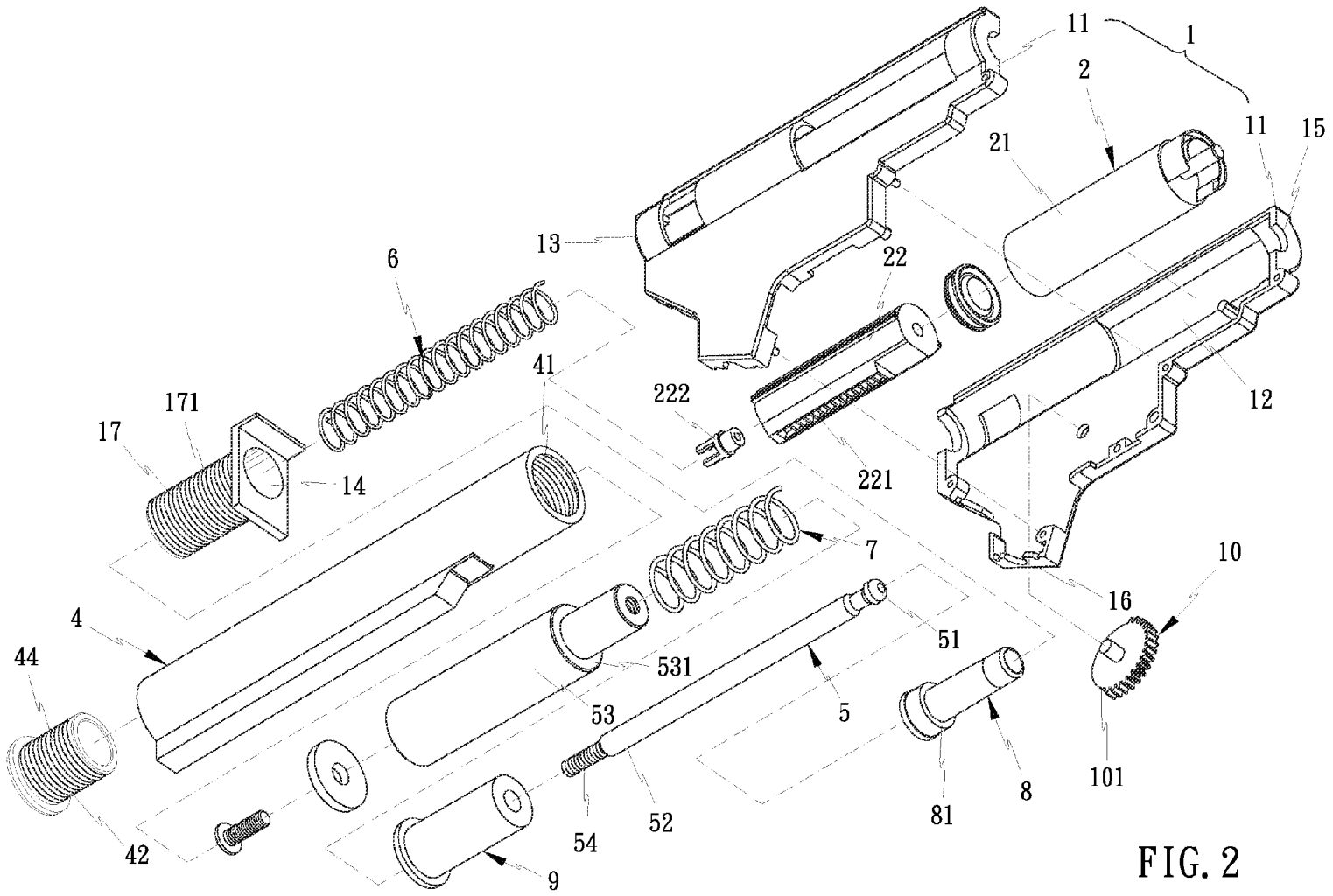
FIG. 2 is an exploded view according to the preferred embodiment of the present invention.

As shown in FIG. 2, the electric toy gun structure for shooting plastic bullets (BB bullets) according to a preferred embodiment of the present invention comprises a casing 1, a firing mechanism 2, a guide pipe 4, a hit rod 5, a first elastic member 6, and a second elastic member 7.

The casing 1 is composed of two semi-casing bodies 11 and has a room 12 therein for installing other mechanisms. The casing 1 has a rear end 13, a front end 15, and a lower end 16. The rear end 13 of the casing 1 has a through hole 14 communicating with the room 12. The front end 15 is adapted for mounting a barrel. The lower end 16 is adapted for mounting a handle. The firing mechanism 2 comprises a cylinder 21 and a piston 22. The cylinder 21 is coupled in the room 12 and pushed by the piston 22 to send out air towards the front end 15 of the casing 1. The piston 22 is disposed in the cylinder 21 to compress air forwards and corresponds to the through hole 14 of the rear end 13 of the casing 1 backwards. In a preferred embodiment, the guide pipe 4 is a hollow pipe as a portion of the butt. The front end of the guide pipe 4 is coupled at the rear end 13 of the casing 1 and communicates with the through hole 14. The hit rod 5 is movably disposed in the guide pipe 4. The hit rod 5 has a first end 51 and a second end 52. The first end 51 of the hit rod 5 passes through the through hole 14 and is located in the room 12. The second end 52 is coupled with a weight 53 through a threaded lock structure 54. The weight 53 is able to reciprocate for simulating vibrations. The first elastic member 6 is disposed in the room 12. A first end of the first elastic member 6 is against the piston 22 of the firing mechanism 2 and a second end of the first elastic member 6 is against the hit rod 5 for pushing the piston 22 to push air forwards. The second elastic member 7 is disposed in the guide pipe 4. A first end of the second elastic member 7 is against the rear end 13 of the casing 1 and a second end of the second elastic member 7 is against the weight 53 of the hit rod 5 for moving the hit rod 5 and the weight 53 backwards to generate vibrations. Thus, the electric toy gun structure of the present invention is assembled.

Figure 1:
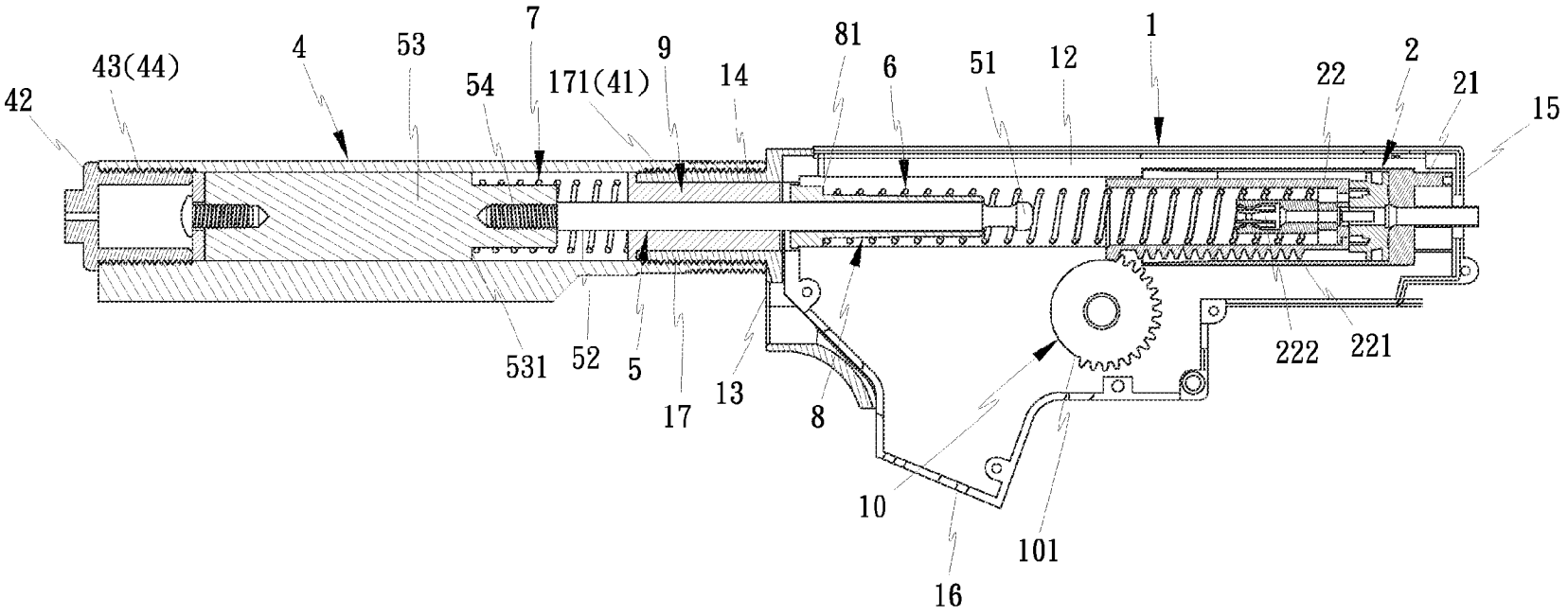
FIG. 1 is a sectional view according to a preferred embodiment of the present invention.

As shown in FIG. 1 and FIG. 2, the present invention further comprises a tubular stop sleeve 8 and a tubular shaft sleeve 9. The stop sleeve 8 is fitted on the first end 51 of the hit rod 5, such that the second end of the first elastic member 6 is against the stop sleeve 8. Preferably, the stop sleeve 8 has a raised-ring first stop portion 81. The first elastic member 6 is a spiral spring fitted in the stop sleeve 8, and the second end of the first elastic member 6 is against the first stop portion 81. The shaft sleeve 9 is disposed in the through hole 14 at the rear end 13 of the casing 1 to seal the through hole 14. The first end 51 of the hit rod 5 passes through the shaft sleeve 9 to be located in the room 12. When it is necessary to disassemble and maintain the electric toy gun structure, the shaft sleeve 9 is taken out backwards so as to take out the stop sleeve 8, the first elastic member 6, the second elastic member 7 and so on.

As shown in FIG. 1 and FIG. 2, the weight 53 of the present invention has a diameter greater than that of the hit rod 5. The weight 53 is formed with a second stop portion 531. The second elastic member 7 is a spiral spring fitted on the hit rod 5. The first end of the second elastic member 7 is against the rear end 13 of the casing 1 and the second end of the second elastic member 7 is against the second stop portion 531 of the hit rod 5.

As shown in FIG. 1 and FIG. 2, the rear end 13 of the casing 1 is integrally formed or connected with a connecting protrusion 17. The through hole 14 passes through the connecting protrusion 17. The front end of the guide pipe 4 is coupled to the connecting protrusion 17. Preferably, the connecting protrusion 17 has first threads 171 thereon. The front end of the guide pipe 4 has second threads 41 therein to engage with the first threads 171. The rear end of the guide pipe 4 is coupled with an end plug 42. Preferably, the rear end of the guide pipe 4 has third threads 43 therein, and the end plug 42 has fourth threads 44 thereon to engage with the third threads 43. The end plug 42 can be detached from the guide pipe 4 to take out the hit rod 5, the stop sleeve 8, the first elastic member 6, the second elastic member 7 and so on for maintenance and replacement.

Figure 3:
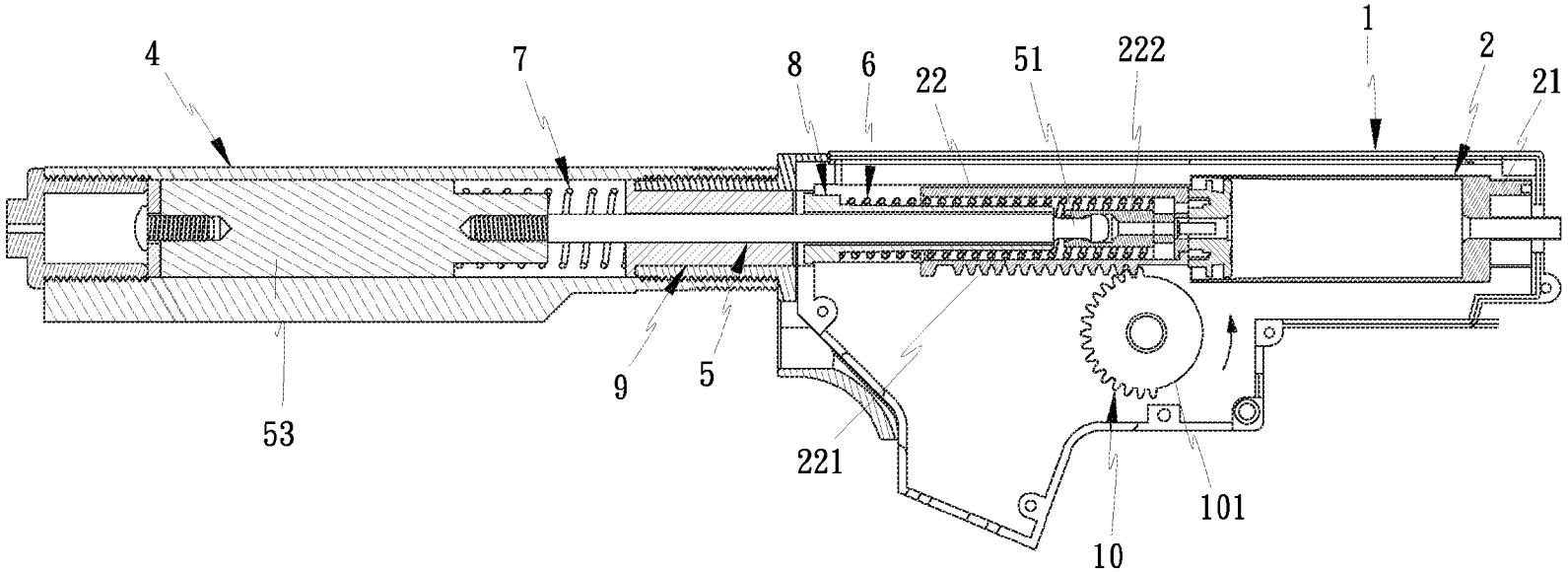
FIG. 3 is a schematic view showing the first operation of the preferred embodiment of the present invention.
Figure 4:
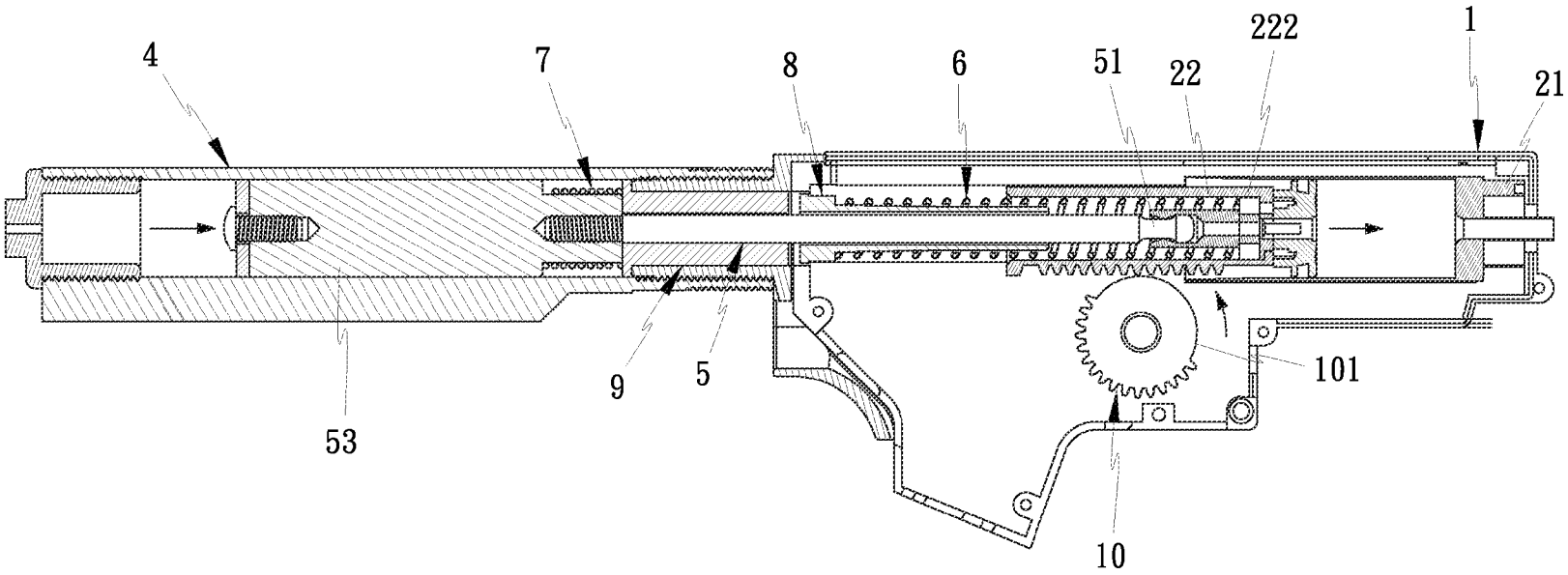
FIG. 4 is a schematic view showing the second operation of the preferred embodiment of the present invention.
Figure 5:
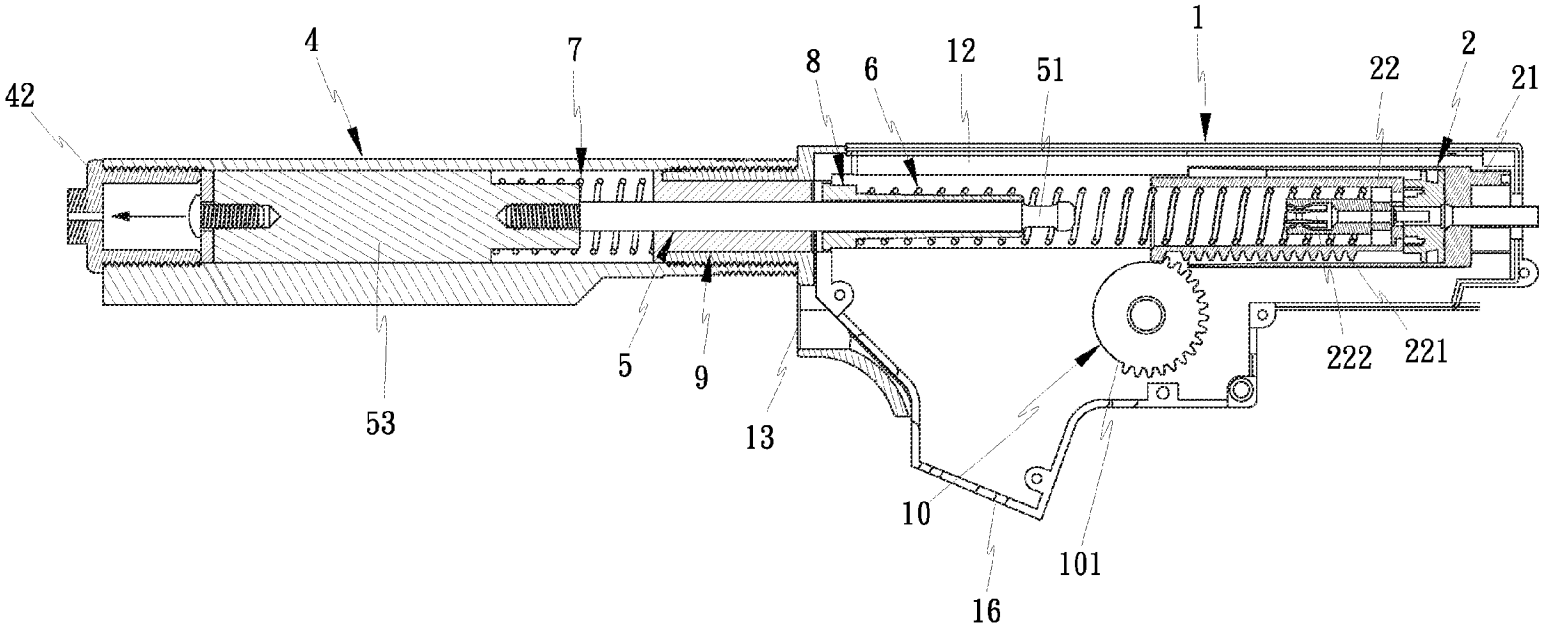
FIG. 5 is a schematic view showing the third operation of the preferred embodiment of the present invention.

As shown in FIG. 3, when the present invention is used, a motor (not shown) in the casing 1 drives a gear 10, and then the gear 10 drives a rack 221 at one side of the piston 22 to move the piston 22 backwards and to compress the first elastic member 6 until a claw 222 inside the piston 22 catches the first end 51 of the hit rod 5. As shown in FIG. 4, when the gear 10 is turned to a non-toothed portion 101, the force to move the piston 22 backwards will be released. Through the elastic force of the first elastic member 6, the piston 22 is pushed forwards to send out the air and the hit rod 5 and the weight 53 are synchronously moved forwards to compress the second elastic member 7. As shown in FIG. 5, until the claw 222 inside the piston 22 is detached from the first end 51 of the hit rod 5, the hit rod 5 and the weight 53 are pushed to the rear end of the guide pipe 4 through the first elastic member 6 and the second elastic member 7 for the weight 53 of the hit rod 5 to hit the end plug 42. Therefore, when the electric toy gun structure of the present invention shoots bullets, the weight 53 of the hit rod 5 is reciprocated to provide a vibration effect like a real gun to shoot bullets.

In particular, as shown in FIG. 1, the present invention composed of the guide pipe 4, the hit rod 5, the first elastic member 6, the second elastic member 7, the stop sleeve 8 and the shaft sleeve 9 provides a vibration effect. Besides, when it is necessary to replace or maintain the first elastic member 6 and the second elastic member 7, the end plug 42 or the connecting protrusion 17 can be detached from the guide pipe 4 to take out the hit rod 5 and the shaft sleeve 9 backwards as well as the first elastic member 6, the second elastic member 7 and the stop sleeve 8 out of the through hole 14 of the casing 1. It is convenient for the user to maintain and replace the elastic members.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An electric toy gun structure comprising:

a casing having a room therein, the casing having a rear end with a through hole communicating with the room;

a firing mechanism disposed in the room, the firing mechanism having a piston corresponding to the through hole;

a guide pipe coupled at the rear end of the casing and communicating with the through hole;

a hit rod movably disposed in the guide pipe, the hit rod having a first end and a second end, the first end of the hit rod passing through the through hole and being located in the room, the second end of the hit rod being coupled with a weight;

a first elastic member disposed in the room, a first end of the first elastic member being against the piston and a second end of the first elastic member being against the hit rod;

a second elastic member disposed in the guide pipe, a first end of the second elastic member being against the casing and a second end of the second elastic member being against the weight; and a gear for driving the piston to move the piston backwards and to compress the first elastic member until a claw inside the piston catches the first end of the hit rod, wherein the first end of the hit rod comprises a bulgy head and a neck, and the claw catches the first end of the hit rod by springily receiving the bulgy head and hooking on the neck.

2. The electric toy gun structure as claimed in claim 1, further comprising a tubular stop sleeve, the stop sleeve being fitted on the first end of the hit rod, the second end of the first elastic member being against the stop sleeve.

3. The electric toy gun structure as claimed in claim 2, wherein the stop sleeve has a first stop portion, the first elastic member being a spiral spring fitted on the stop sleeve, the second end of the first elastic member being against the first stop portion.

4. The electric toy gun structure as claimed in claim 1, wherein the weight has a diameter greater than that of the hit rod, the weight being formed with a second stop portion, the second elastic member being a spiral spring fitted on the hit rod and being against the second stop portion.

5. The electric toy gun structure as claimed in claim 1, further comprising a tubular shaft sleeve, the shaft sleeve being disposed in the through hole, the first end of the hit rod passing through the shaft sleeve to be located in the room.

6. The electric toy gun structure as claimed in claim 5, wherein the rear end of the casing is provided with a connecting protrusion, the through hole passing through the connecting protrusion, a front end of the guide pipe being coupled to the connecting protrusion.

7. The electric toy gun structure as claimed in claim 6, wherein the connecting protrusion has first threads thereon, and the front end of the guide pipe has second threads therein to engage with the first threads.

8. The electric toy gun structure as claimed in claim 7, wherein a rear end of the guide pipe is coupled with an end plug.

9. The electric toy gun structure as claimed in claim 8, wherein the rear end of the guide pipe has third threads therein, and the end plug has fourth threads thereon to engage with the third threads.

10. The electric toy gun structure as claimed in claim 3, wherein the weight has a diameter greater than that of the hit rod, the weight being formed with a second stop portion, the second elastic member being a spiral spring fitted on the hit rod and being against the second stop portion.

11. The electric toy gun structure as claimed in claim 1, wherein the gear drives and moves the piston backwards by driving a rack at one side of the piston.

12. The electric toy gun structure as claimed in claim 1, wherein the gear comprises a non-toothed portion, and when the claw inside the piston catches the first end of the hit rod and the gear turns to the non-toothed portion, the piston will be released from the gear and pushed forwards by the first elastic member to send out air and synchronously move the hit rod and the weight forwards to compress the second elastic member, which will then push the hit rod and the weight to the rear end of the guide pipe.

13. The electric toy gun structure as claimed in claim 1, wherein the gear is driven by a motor in the casing.

* * * * *